US008678187B2

(12) United States Patent
Pickard, Jr. et al.

(10) Patent No.: US 8,678,187 B2
(45) Date of Patent: Mar. 25, 2014

(54) SHIPPING AND INSTALLATION CONTAINER FOR SOFT TUBING

(75) Inventors: George L. Pickard, Jr., Noen Phra (TH); Brad Steverson, Lenoir City, TN (US); Greg Ertel, Clinton, TN (US)

(73) Assignee: Aeroflex USA, Sweetwater, TN (US)

( * ) Notice: Subject to any disclaimer, the term of this patent is extended or adjusted under 35 U.S.C. 154(b) by 78 days.

(21) Appl. No.: 13/195,998

(22) Filed: Aug. 2, 2011

(65) Prior Publication Data

US 2013/0032497 A1 Feb. 7, 2013

(51) Int. Cl.
*B65D 85/20* (2006.01)

(52) U.S. Cl.
USPC ..... 206/446; 206/416; 206/503

(58) Field of Classification Search
USPC ..... 206/443, 321, 446, 504, 503, 394, 585, 206/597, 591, 593, 521, 391, 395, 407, 408, 206/413, 414, 415, 416, 396; 229/147
See application file for complete search history.

(56) References Cited

U.S. PATENT DOCUMENTS

| | | | | | |
|---|---|---|---|---|---|
| 852,010 | A | | 4/1907 | Wright | |
| 2,286,500 | A | * | 6/1942 | Morrill, Jr. et al. | 206/407 |
| 2,307,250 | A | | 1/1943 | Winchell | |
| 2,533,544 | A | | 12/1950 | Zavarella | |
| 3,164,252 | A | * | 1/1965 | Hosbein | 206/597 |
| 3,265,199 | A | | 8/1966 | Parsons | |
| 3,294,225 | A | * | 12/1966 | Kenyon | 206/446 |
| 3,728,883 | A | | 4/1973 | Lamborn et al. | |
| 3,835,986 | A | * | 9/1974 | Le Beau | 206/320 |
| 3,837,480 | A | * | 9/1974 | Brunett | 206/497 |
| 3,899,100 | A | | 8/1975 | Rigaud | |
| 4,058,216 | A | * | 11/1977 | Tsuyuguchi | 206/597 |
| 4,179,033 | A | * | 12/1979 | Mitchell | 211/60.1 |
| 4,291,803 | A | | 9/1981 | Perales | |
| 4,787,513 | A | * | 11/1988 | Auble et al. | 206/407 |
| 4,826,008 | A | * | 5/1989 | Cloosterman | 206/413 |
| 4,907,697 | A | | 3/1990 | Stake et al. | |
| 5,829,592 | A | * | 11/1998 | Henry et al. | 206/416 |
| 2010/0299842 | A1 | * | 12/2010 | Wang | 5/706 |
| 2011/0062181 | A1 | * | 3/2011 | Farley | 221/69 |

* cited by examiner

*Primary Examiner* — Jacob K Ackun
*Assistant Examiner* — Jenine Pagan
(74) *Attorney, Agent, or Firm* — Pitts & Lake, P.C.

(57) ABSTRACT

A shipping and installation container for soft tubing. The container includes a substantially cylindrical section that readily receives soft or foam tubing commonly used on heating or cooling conduits in an industrial plant. End caps are provided at opposite ends of the cylindrical section to facilitate stacking and storing the container laden with soft tubing during shipment. The end caps can be readily removed and the cylindrical section then serves as a guide to facilitate installation of the tubing onto industrial conduit.

8 Claims, 8 Drawing Sheets

SHIPPING AND INSTALLATION CONTAINER FOR SOFT TUBING

CROSS-REFERENCE TO RELATED APPLICATIONS

Not Applicable

STATEMENT REGARDING FEDERALLY SPONSORED RESEARCH OF DEVELOPMENT

Not Applicable

BACKGROUND OF THE INVENTION

1. Field of Invention

The present invention relates to a container for shipping soft tubing used as insulation on mechanical conduits, such as cooling or heating conduits, used in industrial plants. The device also aids installation of the insulation tubing onto the mechanical conduits.

2. Description of the Related Art

Soft tubing which can serve as insulation for mechanical conduits often deforms during storage and shipping. The collapsing wall of the insulation tubing may reduce the readiness and ease with which the tubing can be mounted as by threading on a mechanical conduit for insulation purposes. For example, an installer may have to carefully thread and repeatedly straighten out a tubing section that has become deformed during shipping or storage as it is placed on a mechanical conduit. This increases the time and cost of the tubing installation.

Various packages have been heretofore developed for protecting or transporting cylindrical shaped rolls or the like. However, no known containers have solved the problems of both protecting a soft roll during shipment and of aiding the installation of the tubing on mechanical conduits.

BRIEF SUMMARY OF THE INVENTION

A combined shipping and installation container for soft tubing is described and shown. The container includes a cylindrical container section designed for receiving a section of soft tubing having a pre-selected length. In a preferred embodiment, a short portion, or lip, of the tubing extends beyond at least one of the cylinder section ends and facilitates installation of the tubing onto a mechanical conduit. A releasably attached end cap is provided on each end of the container. The end cap has a wall which defines a chamber which receives and covers one end portion of the cylindrical section. The end cap has at least two flat sides which aid in stacking the container-laden tubing during shipment or storage against horizontally and vertically juxtaposed sides of adjacent end caps. The end caps include an outer face which is flat in one embodiment and an inner face which defines an opening which releasably receives an end portion of the cylindrical container. The opening on one face of the end cap can be cut such that a plurality of inwardly extending tabs can be bent outwardly away from the chamber defined by the end cap wall. These tabs serve to slide along the length of the cylindrical container section when the end cap is mounted on the end thereof and can be used to facilitate joining as with tape the end caps with the cylindrical container during shipment and storage.

BRIEF DESCRIPTION OF THE SEVERAL VIEWS OF THE DRAWINGS

The identified features of the invention will become more clearly understood from the following detailed description of the invention read together with the drawings in which.

DETAILED DESCRIPTION OF THE INVENTION

Figure 1:
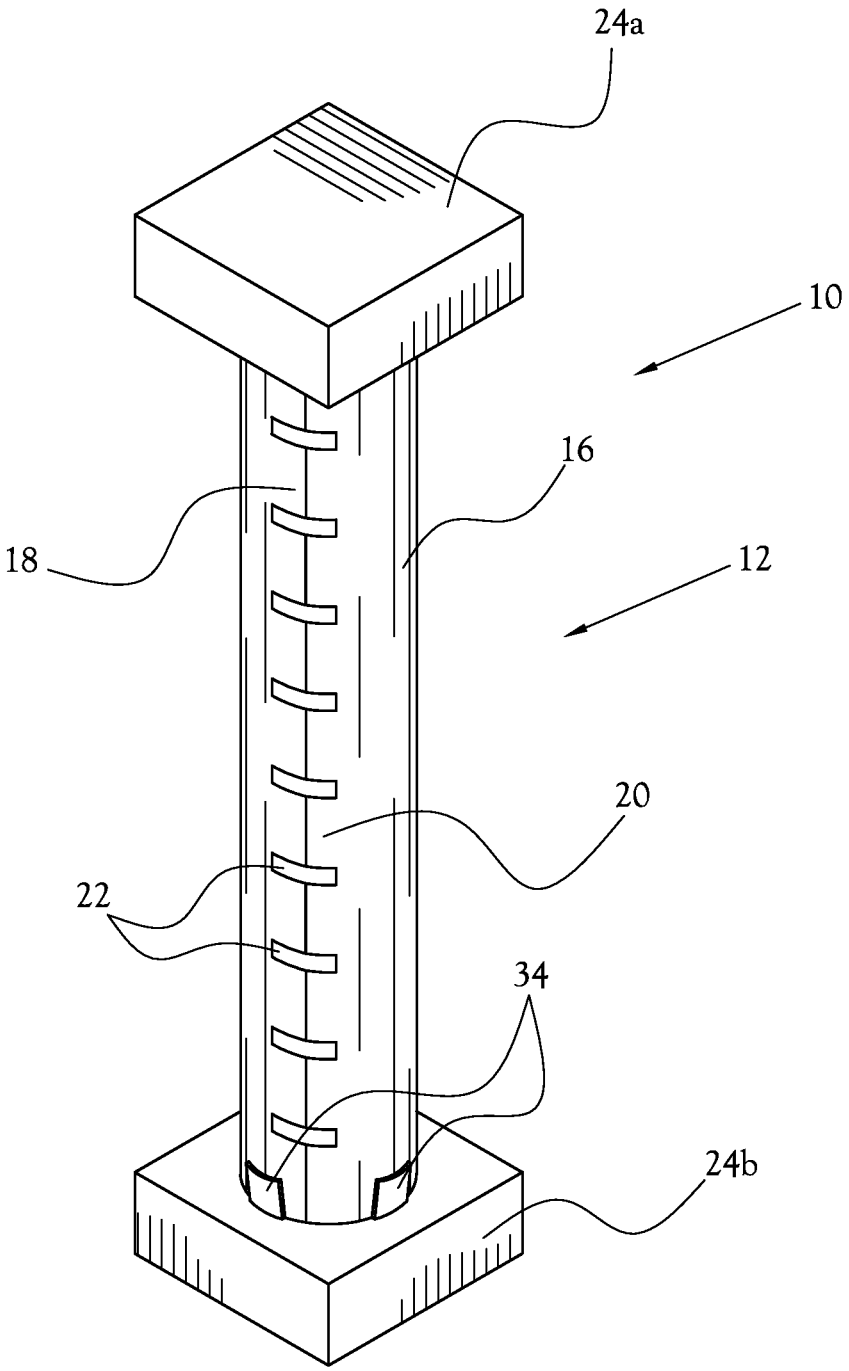
FIG. 1 is a perspective view of one embodiment of the shipping and installation container of the present invention.
Figure 2:
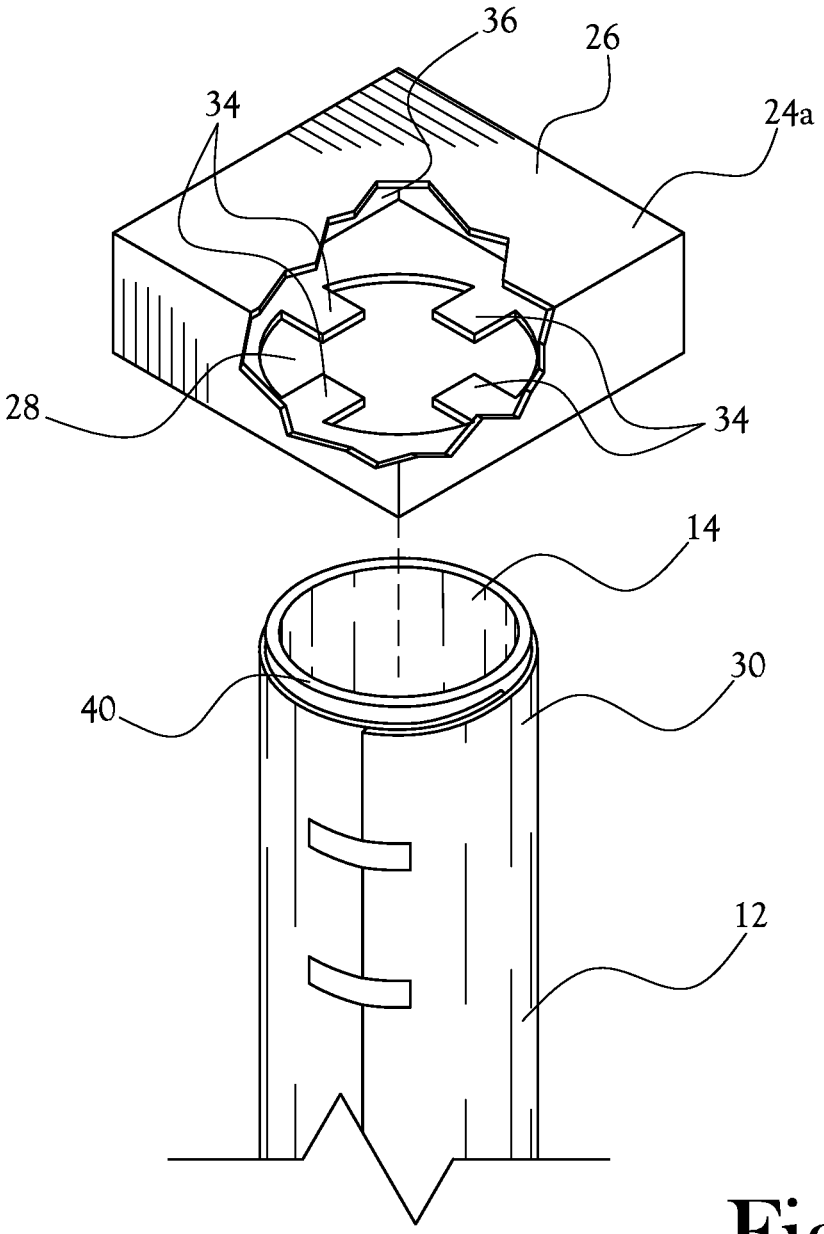
FIG. 2 illustrates an end cap positioned for being releasably mounted on one end of the container cylinder or cylindrical sections bearing and protecting the soft tubing stored therein.

A shipping and installation container for soft tubing is shown at 10 in FIG. 1. This container is particularly designed for receiving soft or foam tubing used in connection with insulating cooling and/or heating conduits in industrial plants. To this end, the container includes a substantially cylindrical section 12 which defines an internal diameter dimension for receiving a related length of soft tubing 14 as shown in FIG. 2. This cylindrical section maintains the soft tubing in its cylindrical shape and prevents collapsing or deforming of the soft tubing during storage and shipment.

The wall 16 of the cylindrical section 12 can be fabricated from a rolled sheet of flat material such as cardboard, or the like, having a preselected thickness. After being formed in a cylindrical configuration, the end 18 of the flat sheet is secured along its length to the adjacent wall 16 at the location 20 by suitable means such as spaced apart sections of tape 22. This tape can be readily removed after installation as will be more clearly described below. Moreover, to enhance the strength and rigidity of the cylindrical section 12, a plurality of layers of flat sheet material can be rolled, one on top of the other, with each layer being fabricated generally as shown in FIG. 1.

To protect the tubing 14 contained within the substantially cylindrical section 12 of the container 10, releasably attached end cap 24*a* and 24*b* are provided. These end caps serve to cover the ends of the cylindrical section 12 and facilitate stacking and storing a plurality of containers. More specifically, the end cap 24*a* as shown in FIG. 2 is provided with a wall 26 that defines an opening 28 for releasably receiving the end portion 30 of the cylindrical section 12. More specifically, the opening 28 is dimensioned slightly larger than the external diameter of the end portion 30 of the cylindrical section 12 such that the end cap can slide onto the end portion 30 thereby protecting the soft tubing 14 contained within the cylindrical section 12. The end caps define flat surfaces which register and are coextensive in both a horizontal and vertical direction for readily stacking containers in a manner generally shown in the container stack 32 in FIG. 3.

Figure 3:
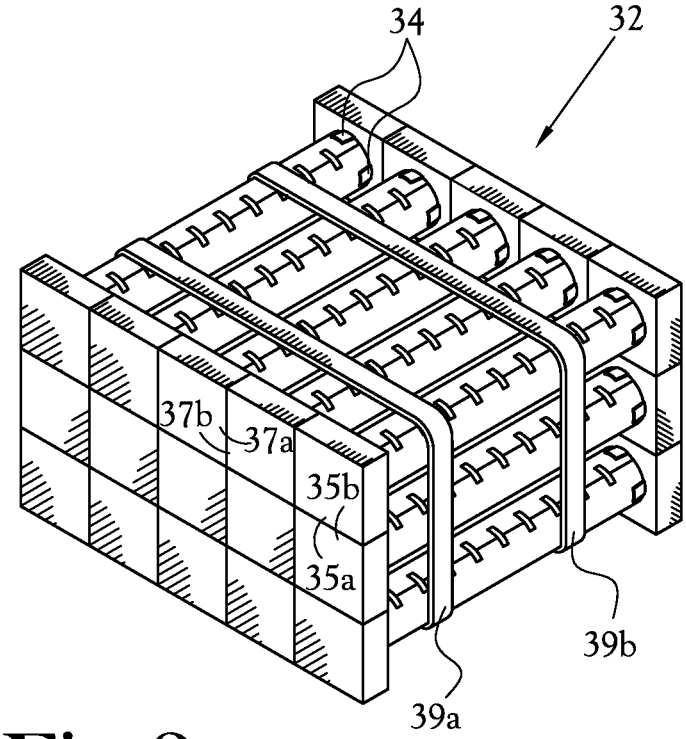
FIG. 3 illustrates a plurality of stacked shipping and insulation containers which are bound together for shipment, the stack could also be shrink wrapped if desired.

In the particular embodiment of the end cap 24*a* shown in FIG. 2, wall 26 proximate the opening 28 is provided with a plurality of tabs 34 that extend inwardly towards each other as shown in FIG. 2 when the opening 28 is cut into the end cap wall. These tabs 34 are designed to be bent outwardly away from the end cap as shown in FIG. 1 and FIG. 3 such that the tabs overlay the adjacent end portion 30 of the cylindrical section 12. These tabs can then be secured as by tape directly to the exterior wall of the cylindrical section such that the relative position of the end caps with respect to the cylindrical wall is fixed. Moreover, the end caps can readily be removed for installing the tubing.

When the end cap is fabricated such that the wall 26 defines a chamber 36 having a substantially rectilinear (rectangular and/or square) cross-section, the end cap orientation at opposite ends of the containers are properly aligned as shown in FIG. 3 to facilitate stacking. To this end, adjacent end caps nest against each other for storage. It will be noted in FIG. 3 that exemplary horizontally adjacent end cap sides 35*a* and 35*b* nest against each other. Similarly, it will be noted that in FIG. 3 exemplary horizontally adjacent end cap side 37*a* and 37*b* nest against each other. In this connection a stable stack is formed which can then be bound by the straps 39*a* and 39*b*.

In the embodiment in FIG. 2 it will be noted that a small section or lip of the soft tubing 14 extends beyond the length of the cylindrical section. This lip is present at both ends of the cylindrical section and is designed to facilitate installation of the soft tubing onto a conduit such as a cooling or heating conduit normally present in industrial plants.

Figure 5:
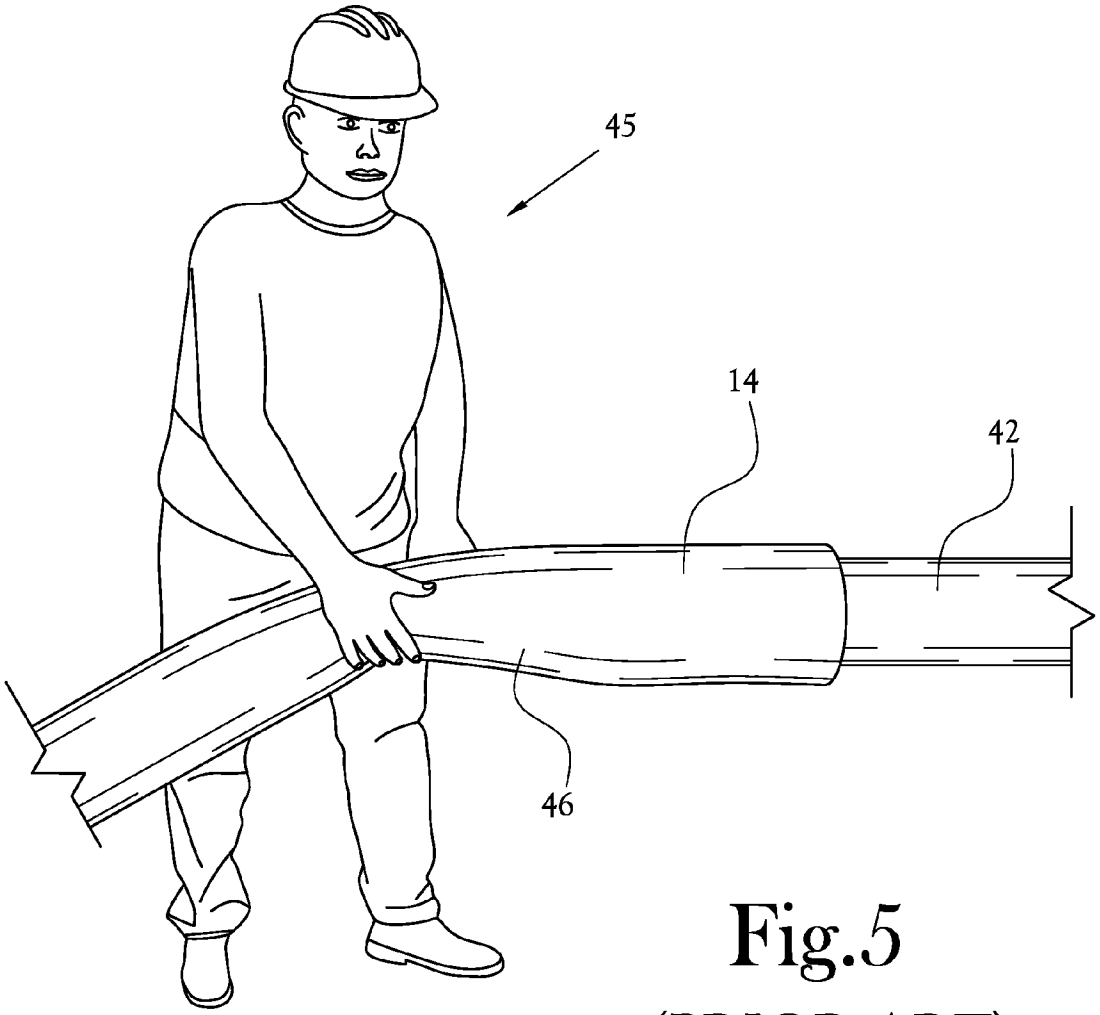
Fig.5 (PRIOR ART)
FIG. 5 illustrates the installation of soft tubing on a mechanical conduit such as a heating or cooling conduit in an industrial plant in which the soft tubing is carried within the cylindrical container section serving as a guide and constructed in accordance with the features of the invention.
Figure 6:
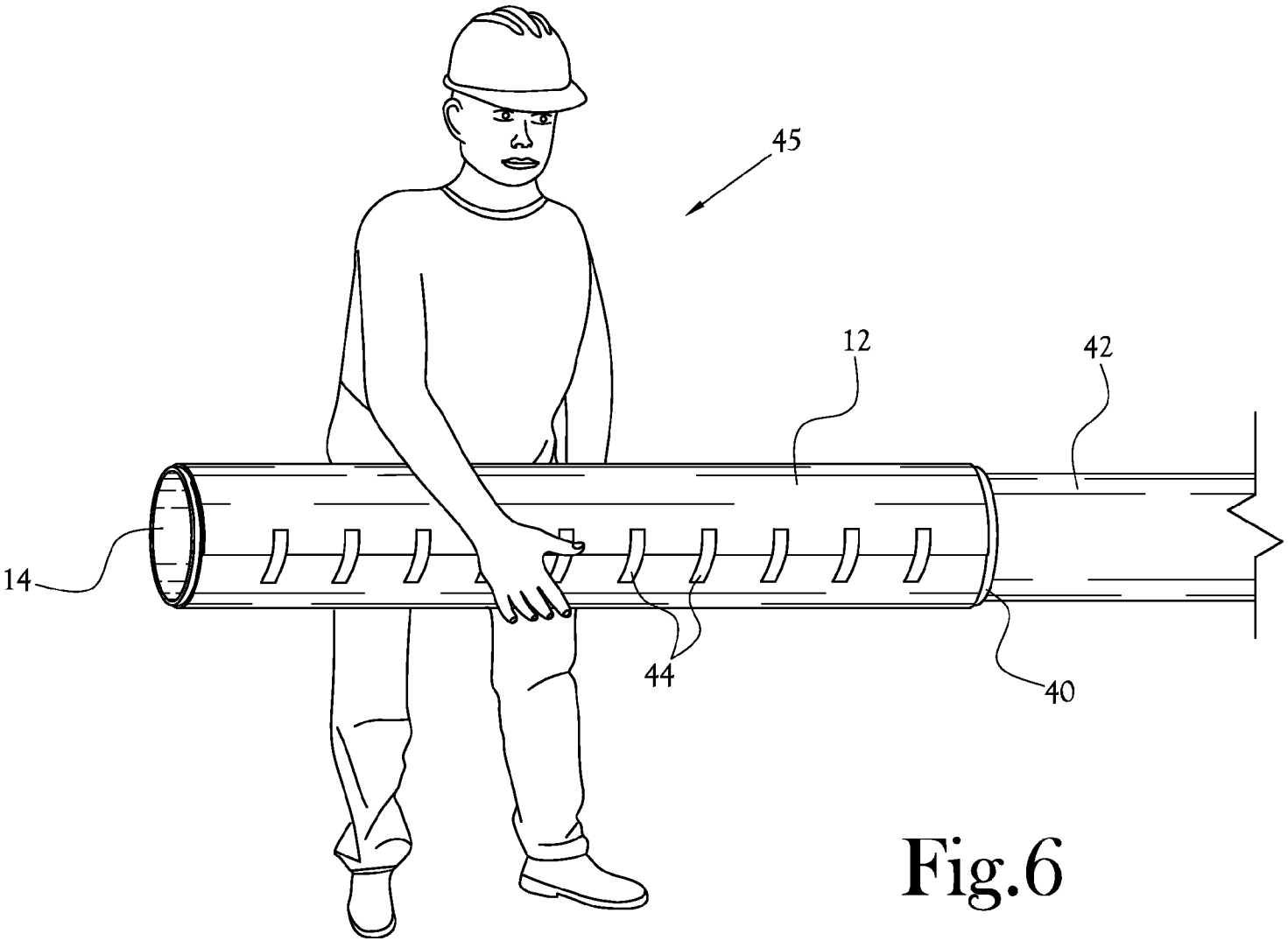
FIG. 6 illustrates an alternate embodiment of one end of the cylindrical container having an inset for protecting the tubing therein during shipment and storage.

More specifically, in the prior art installation illustrated in FIG. 5, the soft tubing 14 is threaded onto the conduit 42 by an installer 45. The soft tubing 14 will normally collapse or deform as is shown at the section 46, thus increasing the labor involved in threading the tubing 14 onto the conduit 42. Contrawise, the installation technique shown in FIG. 6 illustrates that after the end caps have been readily removed, as by removing the tape from the tabs 34 and sliding the end cap away from each end of the tubing, the cylindrical section 12 maintains the tubing in a cylindrical geometry which facilitates and guides the tubing onto the conduit 42.

The lip 40 of the soft tubing which extends beyond the end portion of the cylindrical section 12 enhances the ease with which the tubing 14 can initially be threaded onto the conduit 42 by an installer. The cylindrical section 12 then serves as a guide for guiding the tubing onto the conduit and preventing collapsing or deformity of the tubing 14 of the type shown in the prior art FIG. 5. After the tubing is installed, the cylindrical section can be left on the tubing to shield it from paint or to enhance the insulation effect; i.e., increase the L-value, of the tubing as is desired. Moreover, the cylindrical section 12 can be readily removed by cutting or peeling the tape sections 44 away from the tubing.

Figure 7:
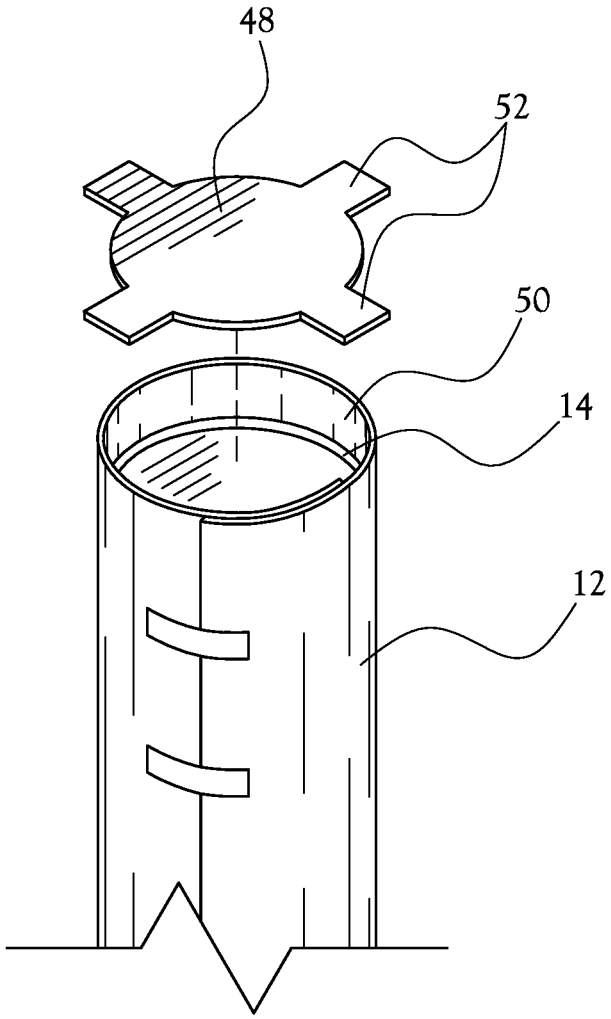
FIG. 7 illustrates an alternate embodiment of the present invention.

An alternate embodiment is shown in FIG. 7 in which an insert 48 is placed within the end portion 50 of the cylindrical section 12. This insert is provided with tabs 52 that are bent upwardly to allow the mid-portion of the insert to be received within the end portion 50 of the cylindrical section 20. These tabs 52 can then be taped to the inside wall surface of the cylindrical section 12 such that the soft tubing 14 is protected during shipment. This insert 48 can be readily removed to facilitate installation of the tubing 14 onto a conduit 42. Moreover, end caps can be releasably mounted to cover the end portions of the cylindrical sections and the tubing contained therein.

Figure 8:
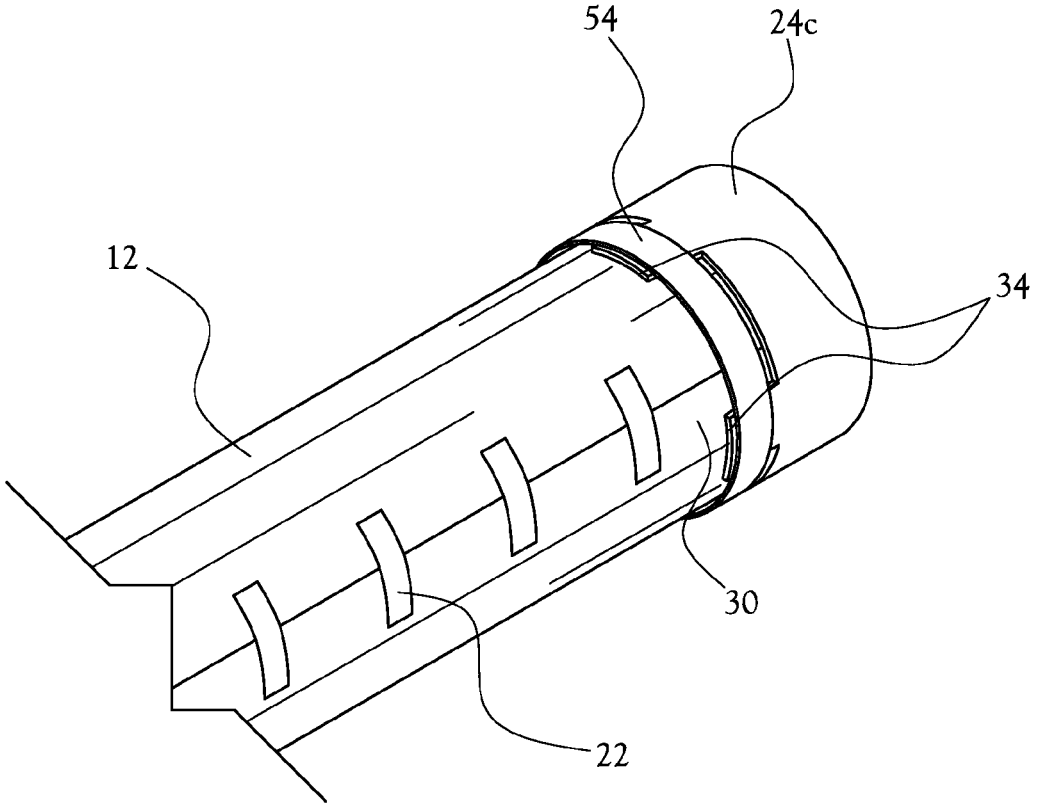
FIG. 8 illustrates an alternate embodiment of the end cap illustrated in FIG. 1.
Figure 9:
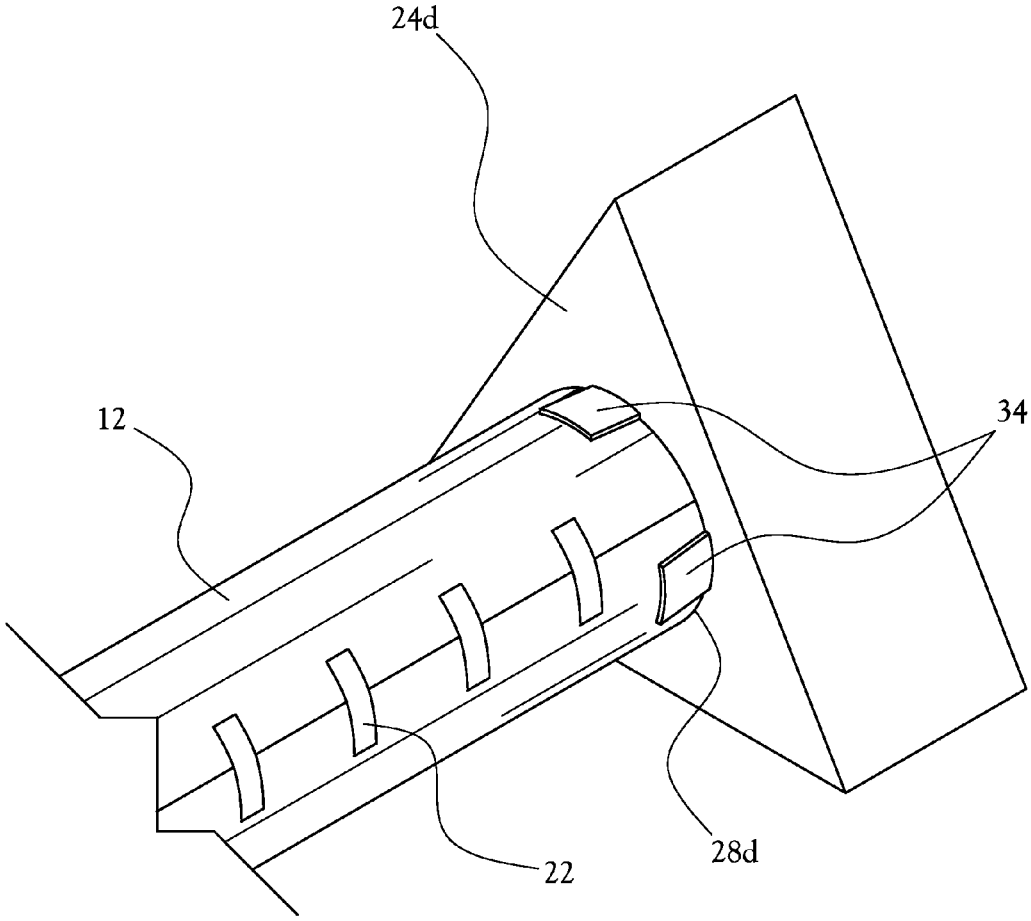
FIG. 9 illustrates an additional alternate embodiment of the end cap illustrated in FIG. 1.

Alternate embodiments of end caps 24*c* and 24*d* are shown in FIGS. 8 and 9 respectively. The end cap 24*c* shown in FIG. 8 is substantially cylindrical in shape and defines an internal chamber having a diameter proportioned for receiving the end portion 30 of the cylindrical section 12. Tabs 34 extend along the outer surface of the end portion 30, as shown, and can be secured to the cylindrical section 12 as with tape 54. Glue or another suitable means could secure the tabs to the wall of the end portion 30.

The alternate end cap 24*d* shown in FIG. 9 has a triangular cross sectional outline and defines an opening 28*d* that receives the end portion 30 of the cylindrical section 12. Tabs 34 can be used to secure this end cap 24*d* to the cylindrical section 12 by tape, an adhesive or the like.

Figure 4:
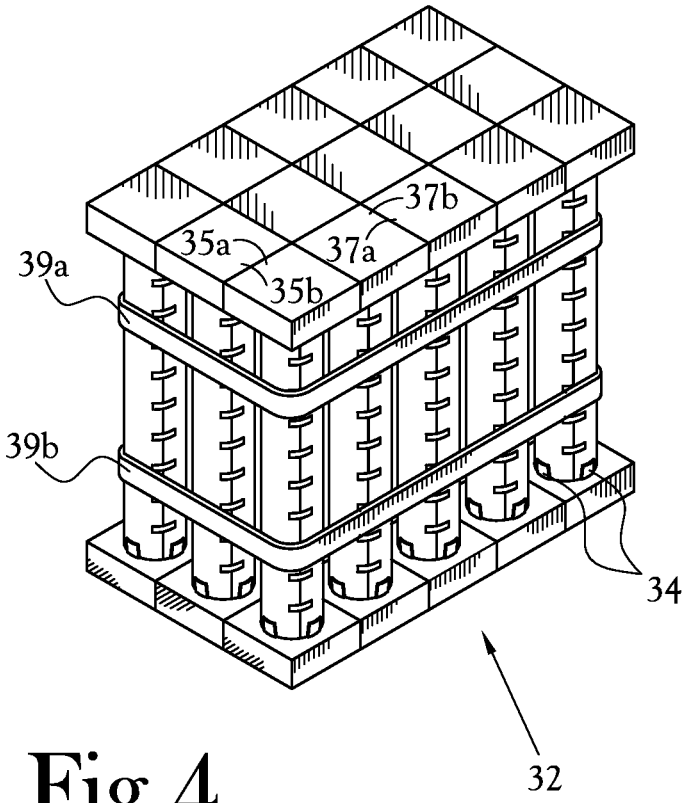
FIG. 4 illustrates difficulty in mounting soft tubing insulation by conventional methods on a mechanical conduit as used in connection with cooling and heating systems of industrial plants.

The containers can be stacked horizontally or vertically (as by standing the containers on their ends) and bound together for shipping or storage. For example, cylindrical end caps 24*c*, the triangular containers 24*d*, and the other end caps shown in FIGS. 1 and 4 terminate in a flat surface that permits the container to be stood on its end. In this connection the end cap flat stacking surface engages the juxtaposed surface (which serves as a flat stacking surface) of the floor. The vertically disposed containers can then be bound together with other similarly shaped containers. FIG. 4 illustrates a vertically disposed stack 32 or group of containers bound together for shipment.

It will be recognized by those skilled in the art that other suitable end caps having various geometric shapes could be used. Normally, at least one face of the end cap will be flat to facilitate stacking the containers. The flat stacking surface can be on end for standing the containers up as shown in FIGS. 1 and 4, such that the longitudinal axis of each container extends in a vertical direction. Alternatively, the containers and end caps may be stacked for storage or shipment such that the longitudinal axis of the container extends in a horizontal direction as shown in FIG. 3. If it is desirable for the containers to be stacked in this orientation, each longitudinally axis will extend horizontally, and each end cap will have a flat stacking surface that is designed to engage a juxtaposed flat standing surface on an adjacent containers end cap to facilitate stacking for storage or shipment as is shown and discussed above in connection with FIG. 3.

While the present invention has been illustrated by description of embodiments, and while the illustrative embodiments have been described in detail, it is not the intention of the applicant to restrict or in any way limit the scope of the scope of the appended claims to such detail. Additional modifications will readily be apparent to those skilled in the art. The invention in its broader aspects is therefore not limited to the specific details, representative apparatus and methods, and illustrative examples shown and described. Accordingly, departures may be made from such details without departing from the spirit or scope of the applicant's general inventive concept.

We claim:

1. A shipping and installation container for soft and/or foam tubing used as insulation for mechanical conduits such as cooling or heating conduits in industrial plants, said container including:

a substantially cylindrical section having opposite end portions and fashioned for receiving a length of soft tubing therein having an external diameter similar to the internal diameter of the container;

a pair of releasably mounted end caps each having a wall defining a chamber, said wall further defining a face having an opening for receiving an end portion of said container therein;

and said end cap defining at least one flat stacking surface, each stacking surface being designed to engage a juxtaposed flat surface to facilitate stacking said containers for storage or shipment;

wherein the said end caps define a plurality of tabs proximate said opening for receiving an end portion of said container, said tabs designed to be bent outwardly away from the end cap and overlay outside the adjacent end portion of the cylindrical section and serving to extend along the cylindrical container wall to facilitate joining said end cap to said container.

2. The shipping and installation container of claim 1 wherein said end cap defines a plurality of stacking surfaces, each stacking surface being designed to engage a juxtaposed flat stacking surface on an adjacent container end cap to facilitate stacking said container for storage or shipment.

3. The shipping and installation container of claim 2 wherein when the length of said container is shorter than the length of said soft tubing received therein, a lip portion of said tubing extends beyond at least the end portion of said container such that said container facilitates installation of said tubing on said conduits.

4. A combined shipping and installation device of claim 2 wherein said container is fabricated from a sheet rolled to form a cylinder.

5. The container of claim 4 wherein the end portion of said container sheet is taped to the wall of said container and can be readily removed after installation.

6. A shipping and installation container for soft and/or foam tubing used as insulation for mechanical conduits such as cooling or heating conduits in industrial plants, said container comprising:

a substantially cylindrical section to receive a length of tubing therein, the cylindrical section having opposite end portions such that when the length of said container is shorter than the length of said soft tubing received therein, a lip portion of said tubing extends beyond at least one end portion of said cylindrical section such that said container facilitates installation of said tubing on said conduits;

a pair of releasably mounted end caps each having a wall defining a chamber, said wall further defining a face having an opening for receiving an end portion of said container therein; and said end cap defining flat stacking surfaces, each stacking surface being designed to engage a juxtaposed flat stacking surface on an adjacent container end cap to facilitate stacking said containers for storage or shipment;

wherein the said end caps define a plurality of tabs proximate said opening for receiving an end portion of said container, said tabs designed to be bent outwardly away from the end cap and overlay outside the adjacent end portion of the cylindrical section and serving to extend along the cylindrical container wall to facilitate joining said end cap to said container.

7. A combined shipping and installation device of claim 6 wherein said container is fabricated from a sheet rolled to form a cylinder.

8. The container of claim 7 wherein said end portion of said container sheet is taped to said wall of said container and can be readily removed after installation.

* * * * *